United States Patent [19]

Parsons et al.

[11] 4,241,676

[45] Dec. 30, 1980

[54] TUFTING MACHINE LOOPER WITH CLIP

[75] Inventors: Ronald Parsons, Blackburn; Ian Slattery, Great Harwood, near Blackburn, both of England

[73] Assignee: Spencer Wright Industries, Inc., Chattanooga, Tenn.

[21] Appl. No.: 91,982

[22] Filed: Nov. 7, 1979

[30] Foreign Application Priority Data

Nov. 16, 1978 [GB] United Kingdom ..... 44857/78

[51] Int. Cl.[3] ..... D05C 15/36

[52] U.S. Cl. ..... 112/79 A

[58] Field of Search ..... 112/79 R, 79 A, 78

[56] References Cited

U.S. PATENT DOCUMENTS

| | | | |
|---|---|---|---|
| 3,075,482 | 1/1963 | Card | 112/79 A |
| 3,084,645 | 4/1963 | Card | 112/79 R |
| 3,595,184 | 7/1971 | Watkins | 112/79 R |
| 4,048,930 | 9/1977 | Card | 112/79 A |

*Primary Examiner*—H. Hampton Hunter

*Attorney, Agent, or Firm*—Alan Ruderman

[57] ABSTRACT

A tufting machine hook with a spring clip secured at one end to the hook shank is resiliently engaged on a face of the bill by a flag on the clip adjacent the other end. An intermediate portion of the clip is bent so as to be disposed out of the plane of the face engaged and toward the opposite face. In one embodiment the face to which the clip is secured and the face engaged by the flag are on the same side and the free end of the clip is elongated. In the other embodiment the clip is secured to the shank at the opposite side to the face engaged by the flag and the clip is bent to cross the plane of the hook.

6 Claims, 4 Drawing Figures

TUFTING MACHINE LOOPER WITH CLIP

BACKGROUND OF THE INVENTION

This invention concerns gauge parts for tufting machines, and more particularly to a hook or looper having a spring clip mounted thereon for cooperation with the bill thereof for the selective formation of cut or loop pile.

It is known in the art to use a hook or looper having a spring clip mounted thereon. A part of the clip bears on the bill of the hook or looper adjacent the free end thereof in the production of tufted fabrics having both cut and loop pile. The loop of yarn seized by the hook or looper from the reciprocating needle selectively is retained on the looper by the clip during subsequent reciprocation of the needle and moves rearwardly of the looper bill eventually to be cut by an oscillating knife cooperable therewith to form cut pile or is released from the looper by displacement of the clip by virtue of the tension in the yarn thus to form loop pile, according to specific requirements.

In conventional loopers having spring clips mounted thereon the clip is formed from flat spring steel strip cut to an appropriate shape and secured to a face of the looper. Adjacent its remote end the clip is formed with a generally triangular enlargement of which the apex bears on the looper bill, and such clip is creased in register with a line of symmetry of the enlargement which passes through the apex thereof, the crease extending towards the plane of that face of the looper to which the clip is secured. The construction is illustrated in U.S. Pat. No. 3,084,645 together with its application in forming cut and loop stitches.

In the context of the loop forming instrumentalities of fine gauge tufting machine, that is to say tufting machines for forming 1/10th inch guage or finer fabrics, the spacing between adjacent like components is limited, and often determines the minimum gauge of the machine.

in the case of loopers having spring clips applied thereto, the presence of the spring clip limits the space available for the knife which cooperates with the next adjacent looper, and thus determines the minimum spacing of the loopers, and hence the gauge of the machine.

SUMMARY OF THE INVENTION

The object of the present invention is to provide a looper/clip combination which will provide a greater clearance between the clip of a given looper and the knife of the next adjacent looper, and thereby allow of a reduction in the minimum gauge of cut/loop tuft forming instrumentalities.

According to the present invention there is proposed a looper/clip combination wherein that part of the free portion of the clip which corresponds to the effective cutting edge of the bill of the looper is arranged in offset disposition inwardly of the plane of that face of the looper against which the free end of the clip bears in relation to the looper. The clip is secured to the shank of the hook at one end thereof and extends through an intermediate portion generally in spaced parallel relation to the bill of the hook. The clip engages one face of the bill at a flag adjacent the free end of the clip and the clip is bent so the intermediate portion is offset from the face engaged by the flag toward the other face.

According to a preferred feature, the clip extends to a position substantially beyond the remote end of the bill.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENTS

Figure 1:
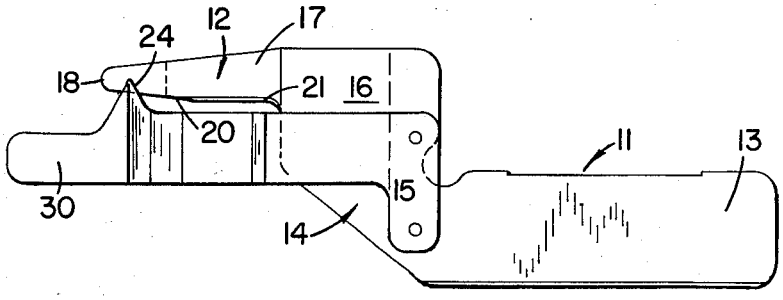
FIG. 1 is a front elevation of a looper/clip combination constructed in accordance with the principles of the present invention.
Figure 2:
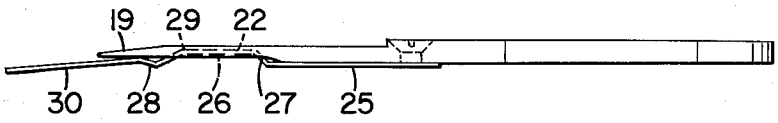
FIG. 2 is a top plan view of the looper/clip illustrated in FIG. 1.

Referring now to the drawings, and particularly to FIGS. 1 and 2 thereof, a looper/clip combination constructed in accordance with the invention comprises a flat looper 11 having a bill 12 and a shank 13, and a spring steel clip 14 secured to such looper 11 as by rivets 15.

The bill 12 and shank 13 extend in offset parallel disposition from respective opposite edges of a body part 16, the looper being generally of planar form and the front face 17 of the bill 12 is ground to curved form as is conventional. The bill is of reducing height towards the free end thereof, such free end terminating in a nose 18 and the rear face 19 of such nose being chamfered, as at 19. The underside 20 of the bill 12 in the region of the throat 21 thereof is inclined to define a rear cutting edge 22 for co-operation with a knife blade, not shown. The rear face of the looper is stepped, the shank 13, and rearmost part of the body 16 being of slightly greater thickness than the remainder of the looper.

The clip 14 comprises a narrow strip of spring steel, one end of the strip having a transverse enlargement to facilitate attachment thereof to the looper, as by rivets 15 engaged with aligned through holes in the clip and looper body, there being a further transverse enlargement of triangular form in spaced disposition relative to the other end of the clip which defines a flag 24 extending towards and for engagement with the nose 18 of the bill 12. The clip is of cranked form, as is best seen in FIG. 2, and includes a flat portion 25 of which one end is rivetted to the looper, an intermediate portion 26 arranged in parallel, offset disposition relative to flat portion 25 and joined thereto by a rearwardly extending web 27, flag portion 28 connected with intermediate portion 26 via a forwardly extending web 29, and a nose 30 at the remote end of the flag portion. In the relaxed state of the clip web 27 is inclined to flat portion 25 at an angle of approximately 45°, whilst web 29 is inclined to the intermediate portion at an angle of approximately 20°, web 29 being of such length as to pass through the plane of the outer face of flat portion 25. Flag portion 28 is creased along a line of symmetry passing through the apex thereof towards the plane of intermediate portion 26, and that part thereof which merges with web 29 is inclined at an angle of approximately 20° to the plane of flat portion 25. The outer part of the flag portion is inclined to the plane of flat portion 25 at an angle of approximately 4°, and nose 30 is co-planar with such part.

As will be appreciated, on mounting the clip on the looper and with the tip of the flag in engagement with the front face of the bill adjacent the nose thereof, the intermediate portion will underlie the bill in closely spaced disposition relative thereto and the clip will be tensioned.

The disposition of the intermediate portion 26, and more particularly its location at the underside of the bill, will provide a greater clearance as between the clip and the knife of the next adjacent looper, and thereby enable the various loop forming instrumentalities to be arranged at closer centers than is possible with prior art arrangements.

The provision of the nose 30 will avoid the danger inherent in conventional arrangements that the point of the clip will penetrate the eye of an adjacent needle if such clip is displaced beyond the normal open position thereof by a slub or knot in the yarn of the needle with which such clip is associated, such penetration inevitably giving rise to damage to the clip and possibly also to adjacent clips. The extension of the nose 30 is such that it never comes behind the needle center-line. There are consequently no points on the clip that can enter the needle eye during the forward stroke of the hook.

Figure 3:
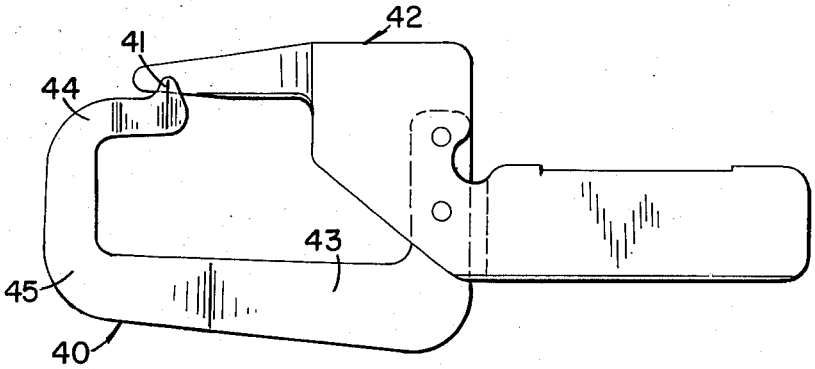
FIG. 3 is a front elevation of another embodiment of a looper/clip combination constructed in accordance with this invention.
Figure 4:
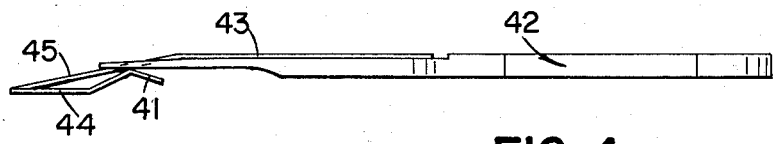
FIG. 4 is a top plan view of the looper/clip illustrated in FIG. 3.

In an alternative arrangement, see now FIGS. 3 and 4, the clip 40 is of elongate U-form, one end of such clip terminating in a flag 41 resiliently engaged with one face of the bill of a looper 42 and the other end being secured to the body of the looper at the other or knife engaging face thereof. The clip comprises two spaced, parallel portions 43,44 of which one terminates in one limb of the U-form and is secured to the looper 42 and of which the other extends inwardly of the U-form and at the upper end of the other limb thereof, that part 45 of the clip which connects the parallel portions 43,44 extending from back to front of the looper and including the other limb of the aforesaid U-form.

At its free end the said other parallel portion 44 merges into the flag 41, such flag being of triangular form and being creased about a line of symmetry thereof which passes through the apex of such triangle to give an outwardly facing U-shaped channel.

The offset disposition of that part 43 of the clip which corresponds to the cutting edge of the looper rearwardly of the front face, as shown, of the looper provides clearance for the knife, not shown, of the next adjacent looper, thereby allowing of the use of the looper/clip combination in the loop forming instrumentalities of a fine gauge tufting machine.

As before, the extension of the clip forward of the nose of the looper avoids interference between such clip and the eye of the next adjacent needle, it being understood that the clip extends beyond the center line of the needle even in the retracted position of the looper, and thereby precludes the possibility of damage to the clip and to adjacent clips.

The invention is not restricted to the exact features of the two embodiments disclosed, since alternatives will readily present themselves to one skilled in the art. Thus, for example, a looper combination of the kind shown in FIGS. 1 and 2 may be modified to the extent that the clip is secured to the knife engaging face of the looper, or the combination of FIGS. 3 and 4 modified in such way that the clip is secured to the front face of the looper as in FIGS. 1 and 2 if preferred. Other arrangements will readily present themselves to one skilled in the art. All such modifications which do not depart from the spirit of the invention are intended to be included within the scope of the appended claims.

Having thus set forth the nature of the invention what is claimed herein is:

1. In combination, a hook and spring clip for use in a tufting machine, said hook being planar and comprising a shank having a mounting portion and a bill extending therefrom to define a throat therebetween, said bill having a top edge and a bottom edge extending from said throat to form a nose, said spring clip having one end secured to the shank and extending to a free end through an intermediate portion generally in spaced parallel relation to said bill, a flag adjacent the free end resiliently engaging said nose at one face of said hook, said flag being defined by a pair of webs converging at a crease in said clip, a first of said webs extending toward said free end, the other of said webs extending toward said intermediate portion and merging into said intermediate portion at an angle, said intermediate portion being disposed beneath said bill and spaced out of the plane of said one face of said hook engaged by said flag toward the other face of said hook.

2. In the combination recited in claim 1 wherein said intermediate portion is disposed intermediate the planes of the sides of said hook.

3. In the combination as recited in claims 1 or 2 wherein said first of said webs terminates in a nose at the free end of the clip, said nose being elongated from said first web to said free end.

4. In the combination as recited in claim 1 wherein said clip is secured to said shank on one face thereof, said intermediate portion is disposed in a plane substantially co-planar with said one face of said shank, and said one face of the shank being the face opposite to the face of the bill engaged by said flag.

5. In the combination as recited in claim 4 wherein said other of said web is bent at a first angle to form a part thereof substantially parallel to said intermediate portion.

6. In the combination as recited in claim 5 wherein said part of said web parallel to said intermediate portion extends beyond the nose of said hook relative to said shank, and said web has a second part thereof at an angle to said first part and crossing the planes of the faces of said hook to merge with said intermediate portion.

* * * * *